United States Patent [19]

Chang

[11] Patent Number: 4,938,044

[45] Date of Patent: Jul. 3, 1990

[54] COMBINATION LOCK WITH VARIABLE CODE

[76] Inventor: Chin-Chen Chang, No. 27, Lane 107, Mi Tou Road, Chiayi, Taiwan

[21] Appl. No.: 415,749

[22] Filed: Oct. 2, 1989

[51] Int. Cl.[5] ..... E05B 37/00

[52] U.S. Cl. ..... 70/315; 70/312

[58] Field of Search ..... 70/384, 315, 316, 317, 70/318, 312

[56] References Cited

U.S. PATENT DOCUMENTS

| | | | |
|---|---|---|---|
| 1,583,687 | 5/1926 | Hatch | 70/318 |
| 1,940,789 | 12/1933 | Diaz | 70/316 |
| 2,003,650 | 6/1935 | Hosking | 70/315 |

*Primary Examiner*—Robert L. Wolfe

*Attorney, Agent, or Firm*—Browdy and Neimark

[57] ABSTRACT

The present disclosure is related to a combination lock with code thereof randomly variable, which is equipped with a pair of parallel rods disposed within an oblong casing; the upper actuation rod is provided with a number of spaced actuation claws with a corresponding number of dial wheels secured to the lower slide rod. Part of the dial wheels is exposed externally of the casing for easy dialing operation thereof. On each dial wheel there are disposed ten axial holes in accordance with consecutive digits 0–9, and a matching restraint wheel in securing engagement with each actuation claw is equipped with a pair of protrusion rods on the side facing each dial wheel which is in selective engagement with two holes of the dial wheel so to enable an operator to set new code by first making each restraint wheel disengaged from the dial wheel by way of the movement of the actuation claws secured on the actuation rod, and rotating the dial wheel to a new position and then making the restraint wheel engaged with the same again.

2 Claims, 7 Drawing Sheets

COMBINATION LOCK WITH VARIABLE CODE

BACKGROUND OF THE INVENTION

The present invention is related to a combination lock which is equipped with a mechanism, permitting an operator to randomly vary the code thereof with ease. The improved combination lock of the present invention comprises a casing, an actuation rod and a slide rod disposed in parallel with each other, a pair of spring biased abutment rods and a pair of spring biased releasing rods that are in orthogonal engagement with the actuation rod and the slide rod respectively. The actuation rod is provided with a number of spaced actuation claws in respective engagement with a number of spaced restraint wheels disposed on the slide rod, each restraint wheel is disposed beside and in separable association with one corresponding dial wheel. Each releasing rod and the actuation rod and slide rod are provided with a recess thereon so as to selectively permit the slide motion of the actuation rod with respect to the releasing rod, and the slide rod with respect to the releasing rod respectively, thereby the dial wheels freed from the engagement of the restraint wheels by actuation claws of the actuation rod can be randomly rotated and a new code be set when the restraint wheels each having a central hole for the passage of the slide rod, on the wall of the hole being provided with a keyway, are engaged with the dial wheels again. Only when the restraint wheels in combination with the dial wheels are rotated to the right positions, i.e., the set positions, the keyways on the restraint wheels will come into alignment with the linearly positioned keys on the slide rod, permitting the spring biased slide rod to move back as long as the related releasing rod is pressed down so as to unlock the lock.

There is a common disadvantage associated with the general prior art combination locks adapted for suitcases of other burglar proof purposes, i.e., the codes of the combination locks are not variable. Such invariation of the code of a combination lock results in the following inconveniences:

1. A person using a number of combination locks simultaneously has to keep all the set codes well in mind, thus the combination locks are not facilitating to operate in one respect; and trouble may arise once the codes are forgotten or lost in the other respect. 2. Once the invariable code is exposed to the notice of other people, the combination lock becomes useless in consideration of security.

Furthermore, the common key operated locks have also disadvantages which cause the following inconveniences: 1. To carry the keys around is inconvenient, and the loss of key results in the awkwardness of locking himself or herself outside the door.

2. The constant of residents of a released house makes the landlord busy in changing the key-operated locks.

To solve the above cited problems associated with the prior art locks, the present inventor has worked out an improved conbination lock having a randomly variable code, the detailed decription thereof is given as below:

SUMMARY OF THE INVENTION

The primary object of the present invention is to provide a combination lock which is equipped with a mechanism so as to permit a person to vary the code thereof with ease.

One other object of the present invention is to provide a combination lock which is equipped with an actuation rod with a number of actuation claws secured thereon; a slide rod in parallel with the former; and a number of restraint wheels in engagement with the actuation claws, which are used to selectively in engagement with the dial wheels in code setting operation.

One still further object of the present invention is to provide a combination lock which is provided with a pair of spring biased releasing rods in engagement with the actuation rod and the slide rod respectively.

One still further object of the present invention is to provide a combination lock which is provided with a pair of spring biased abutment rods which are disposed at the end of the spring biased actuation rod and the slide rod, orthogonally disposed with respect to the same. Each abutment rod has a cam protrussion disposed at the middle thereof which is able to urge the spring biased rods forward as long as the spring biased abutment rod is pressed down. To better illustrate the operation modes and structure and features of the present invention, a number of drawings are given in company with a detailed description of the preferred embodiment, in which:

DETAILED DESCRIPTION OF PREFERRED EMBODIMENT

Figure 1:
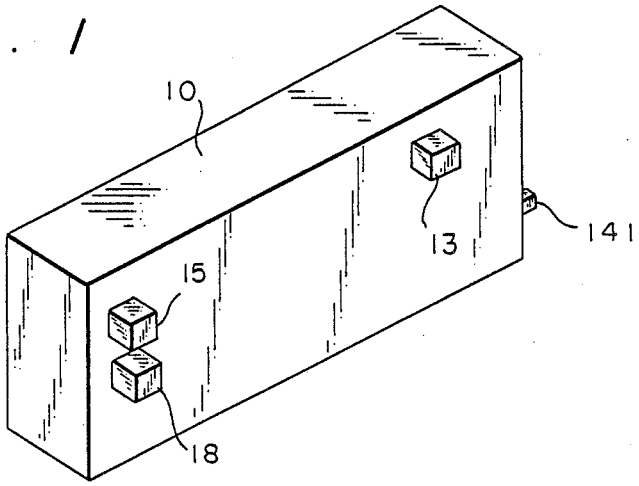
FIG. 1 is a rear prespective view of the present combination lock with randomly adjustable code.
Figure 2:
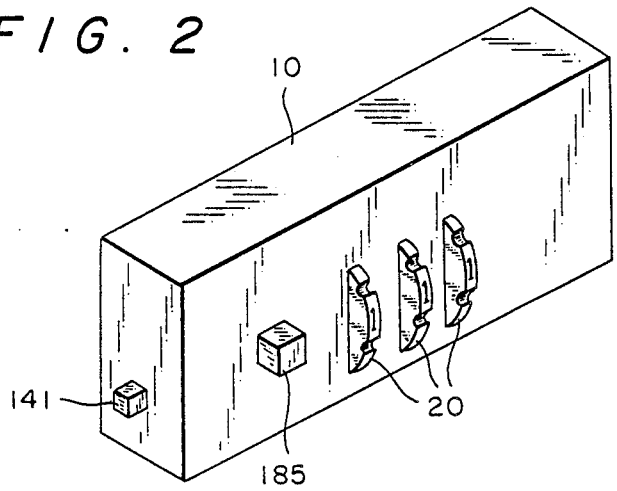
FIG. 2 is a front perspective view of the present combination lock.
Figure 3:
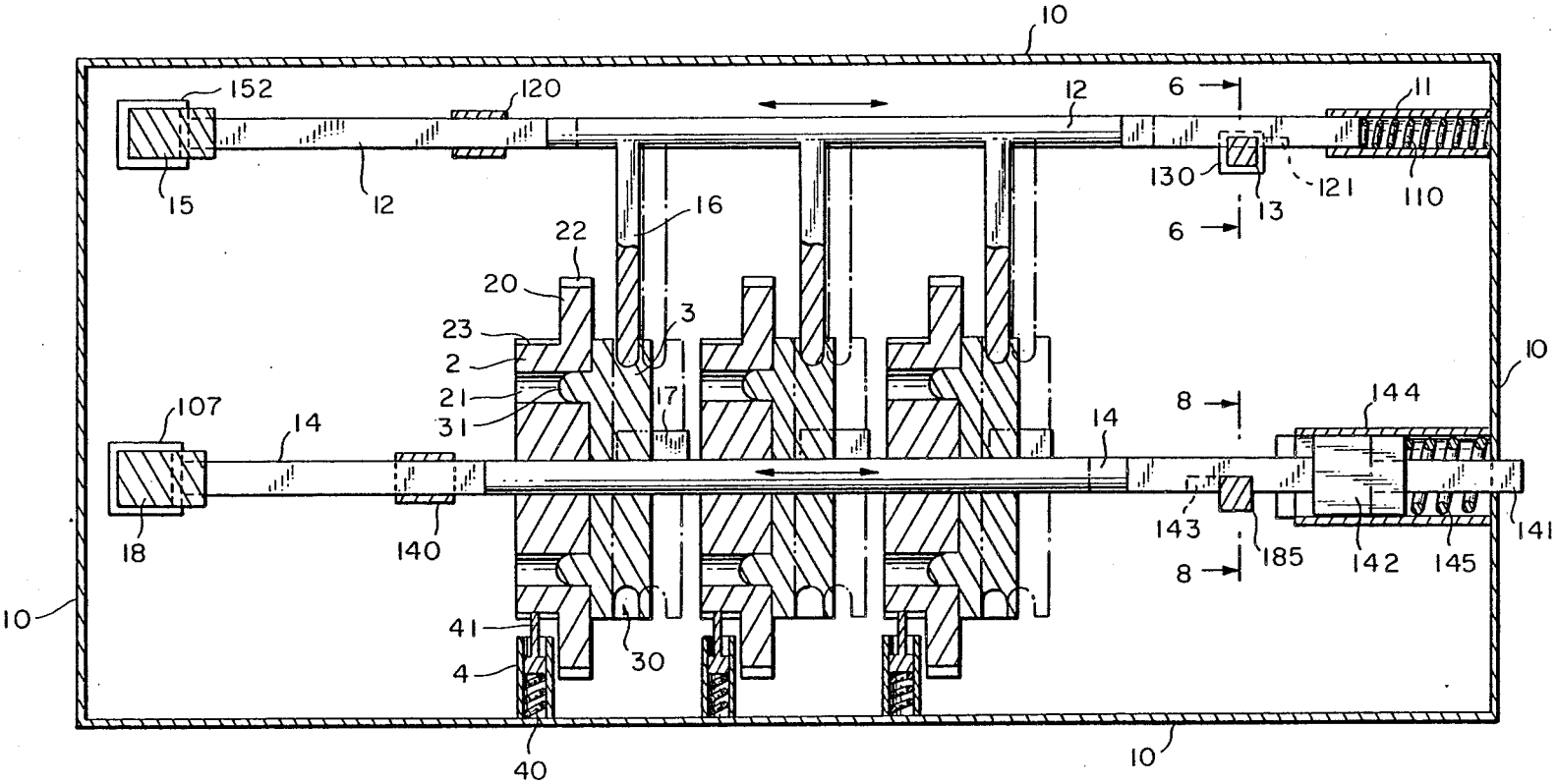
FIG. 3 is an enlarged sectional view of the present combination lock, showing the operation mode of the present invention.
Figure 5:
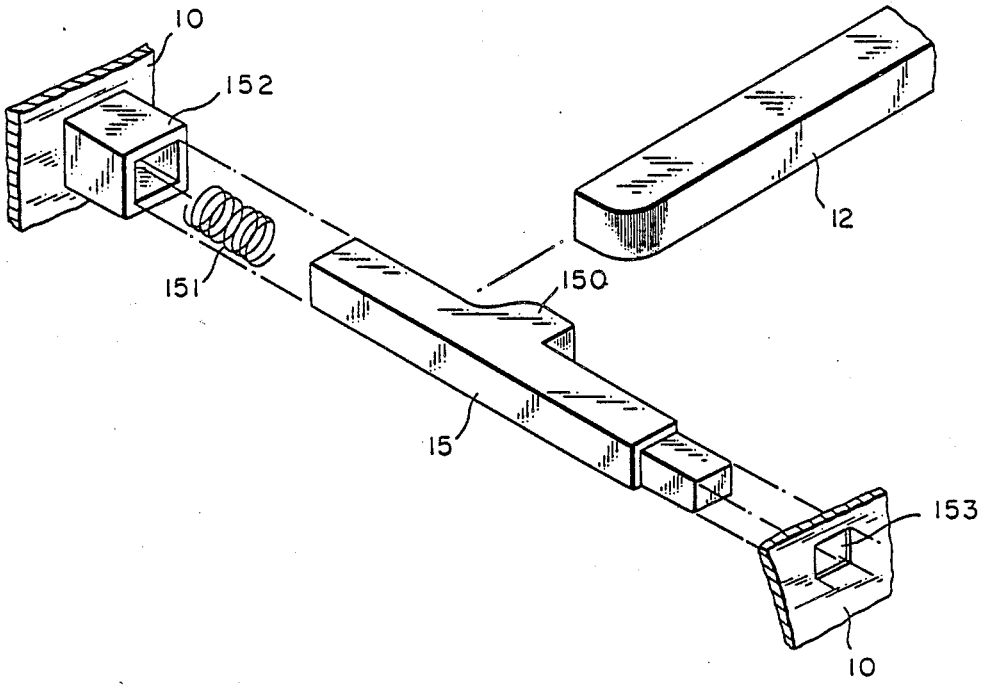
FIG. 5 is a diagram showing the arrangement of the actuation rod 12 and the first abutment rod 15.
Figure 6:
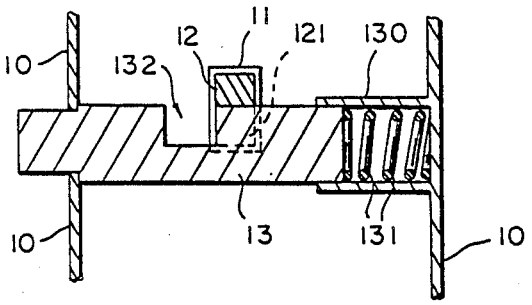
FIG. 6 is a sectional view, taken along line 6—6 in FIG. 3, showing the engagement of the acutation rod with respect to the releasing rod.
Figure 9:
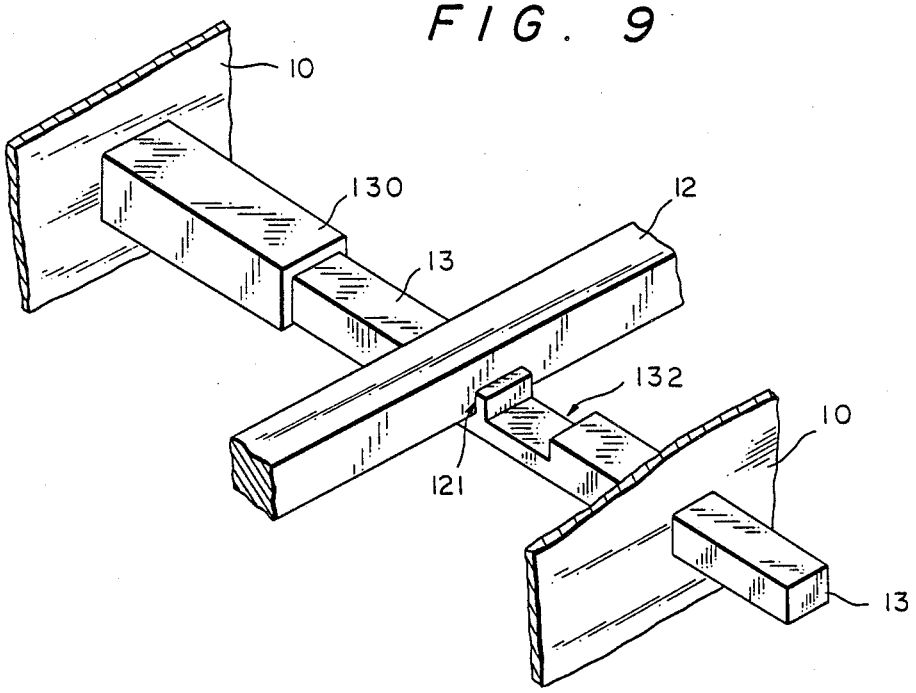
FIG. 9 is a diagram showing the actuation rod 12 being out of alignment with the recess 132 of the first releasing rod 13.
Figure 10:
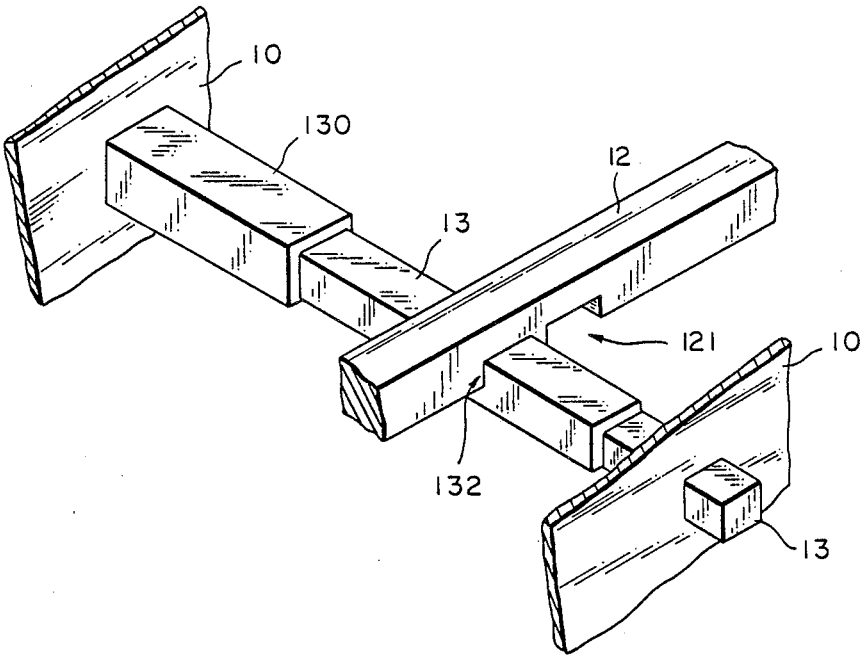
FIG. 10 is a diagram showing the actuation rod 12 coming into alignment with the recess 132 of the first releasing rod 13 with the rod 12 being pushed back and the recess 121 moving out of engagement with the first releasing rod 13.

Referring to FIG. 1 to FIG. 3, the present invention comprises an oblong casing 10; an upper actuation rod 12 having the right end thereof received in abutment with a spring 110 in a tubular protrusion 11 extented from the wall of the casing 10, and the left end supported wall-mounted seat 120; a recess 121 being disposed near the right end thereof, as shown in FIGS. 6, 9, 10. Positioned in orthogonal relation with the upper actuation rod 12 is a first releasing rod 13 having a recess 132 and supported in place at one end by a wall-protruded tube 130 having a spring 131 receiving therein which is disposed in abutment with the terminal end of the first releasing rod 13; the other end of the same being exposed externally of the casing 10 for ready pressing operation by the operator. A first abutment rod 15 is secured to the casing 10 at one end by a wall-protruded tube 152 with a spring 151 received therein which is in abutment with the terminal end of the rod 12, and the other end of the same is exposed externally of the casing 10 through a window 153, as shown in FIG. 5. At the middle of the first abutment rod is disposed a cam contour 150 in abutment relation with the end of the upper action rod 12. Thereby, an operator can press the first abutment rod to move the actuation rod together with the actuation claws thereon against spring force in code setting practice.

Figure 4:
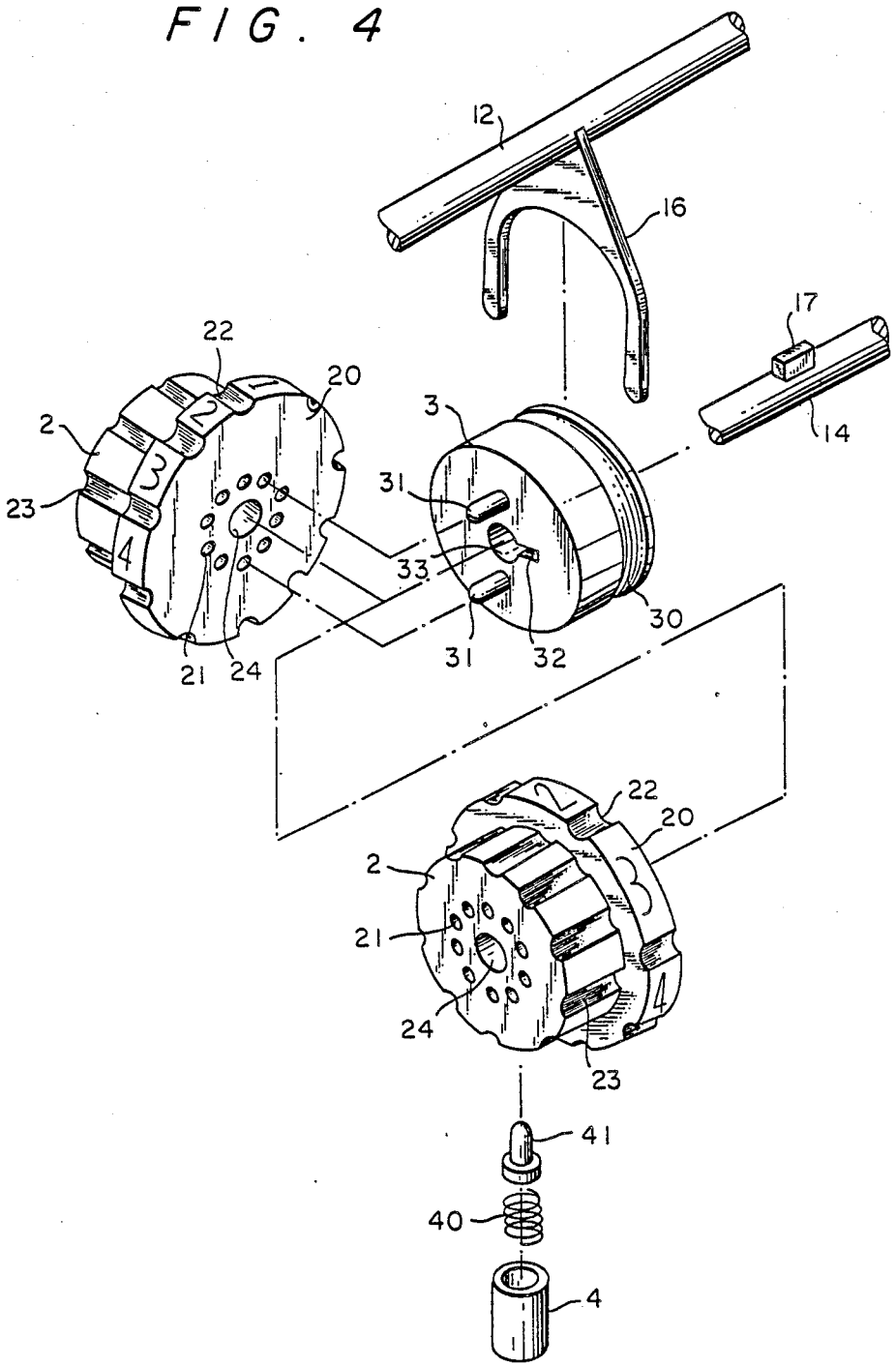
FIG. 4 is a diagram showing the exploded components of the actuation rod with the C-shaped actuation claw, a restraint wheel, the slide rod and the dial wheel.

As shown in FIG. 4, on the middle of the actuation rod 12 are disposed 3 symmetric spaced actuation claws 16 which are defined in C-shaped form with two legs extended downward.

Figure 7:
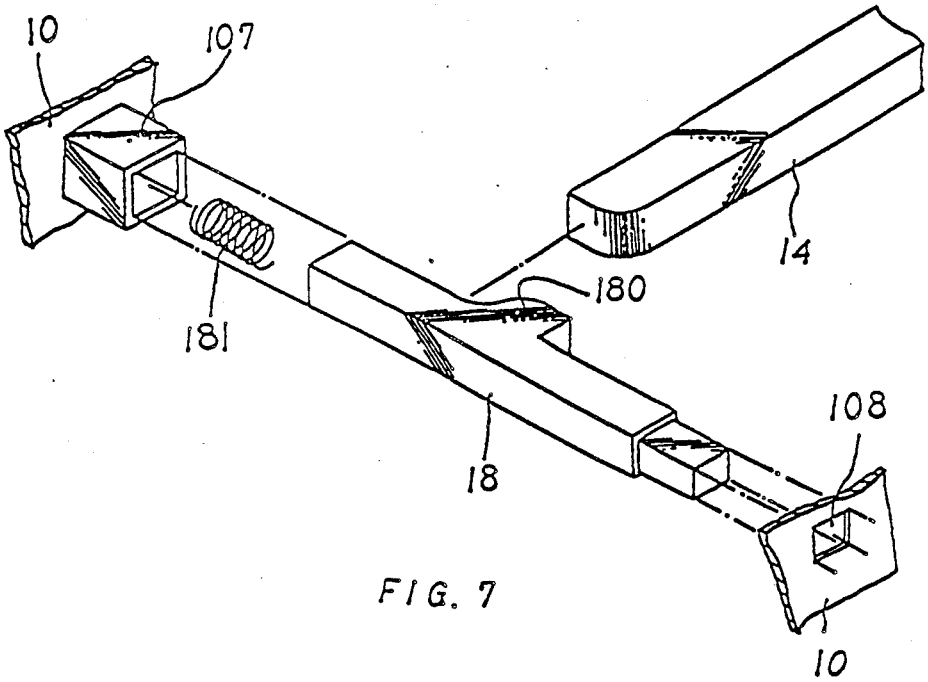
FIG. 7 is a diagram showing the arrangement of the slide rod 14 and the second abutment rod 18.

A lower slide rod 14 located within the casing 10 in the same way as the actuation rod 12. Near the right end thereof is disposed an enlarged portion 142 with the rightmost end thereof 141 extended out of the casing 10, serving as a latch head. The right end of the lower slide rod 14 is supported in place by a wall protruded tube 144 having a spring 145 disposed therein which is in resilient abutment with the enlarged portion 142 so that the latch head 141 can be resiliently operated. The other end of the slide rod 14 is supported in place by a supporting seat 140, and is in contact with a second abutment rod 18 as shown in FIG. 7. At the middle of the second abutment rod 18 is disposed a cam contour 180 which is in selective contact with the end of the slide rod 14. The right end of the second abutment rod 18 is extended through a window on the casing 10 and exposed externally, and the opposite left end thereof is in registry with a wall protruded tube 107 with a spring 181 disposed in abutment therewith.

Figure 8:
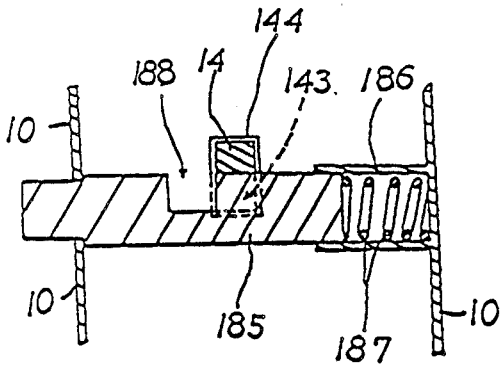
FIG. 8 is a sectinal view, taken along line 8—8 in FIG. 3, showing the engagement of the second releasing rod 185 with respect to the slide rod 14.
Figure 11:
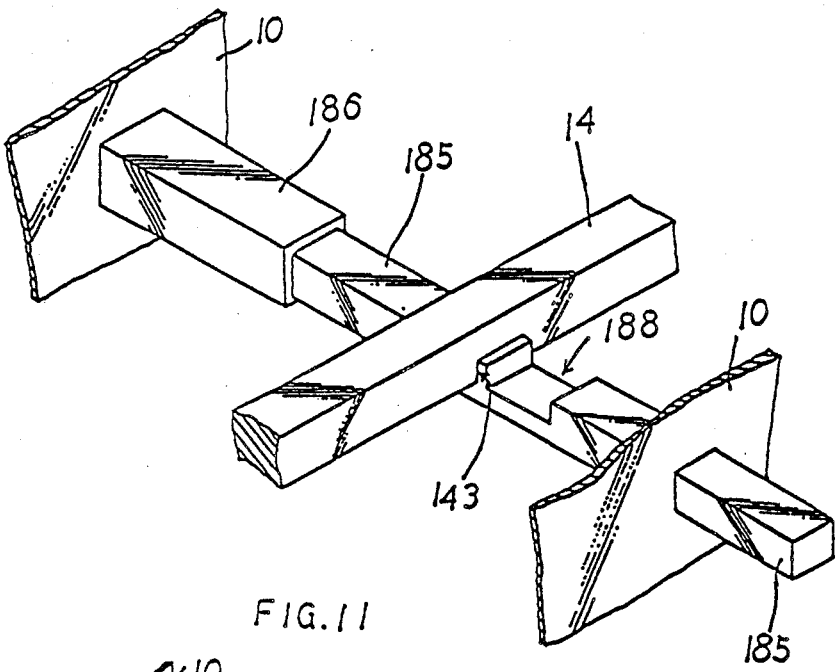
FIG. 11 is a diagram showing the slide rod 14 being out of alignment with the recess 188 of the second releasing rod 185.
Figure 12:
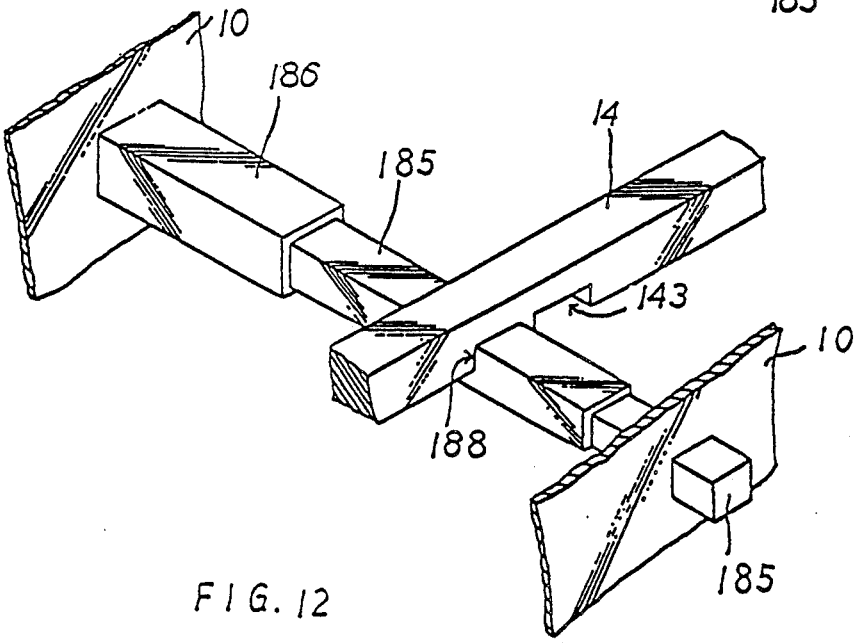
FIG. 12 is a diagram showing the slide rod 14 coming into alignment with the recess 188 of the second releasing rod 185 with the slide rod 14 being pushed back and the recess 143 moving out of engagement with the second releasing rod 185.

Referring to FIGS. 8, 11, 12, the lower slide rod 14 is provided with a recess 143 thereon which is positioned in orthogonal relationship with the recess 188 of a second releasing rod 185. The right end of the second releasing rod 185 is supported in place by a wall protruded tube 186 having a spring 187 disposed therein which is in contact with the end of the second releasing rod; and the left end of the same is exposed externally of the casing 10. A number of spaced square keys 17 are disposed on the lower slide rod 14, as shown in FIG. 4.

Each of the 3 digital dial wheels 20 is provided with a central through hole 24 through which the slide rod 14 is led with the dial wheels secured thereto. Part of each dial wheel 20 is exposed externally of the casing, as illustrated in FIG. 2; the periphery of the dial wheel 20 is provided with a number of ditches 22 dividing the periphery into 10 sections marked with numerals 0–9 respectively. A cylindrical protrusion 2 is extended from one side of the dial wheel 20; there are 10 axially oriented through holes 21 disposed on the cylindrical protrusion 2 and being in corresponding relation with the number-related ditches 23.

There are 3 restraint wheels 3, referring to FIG. 4, each having a central through hole 33 which is provided with a keyway 32 on the inner wall thereof. On one side of the restraint wheel 3 are disposed a pair of symmetric protrusion rods 31 with the through hole 33 located therebetween, which are in selective engagements with a pair of holes 21 of the cylindrical protrusion 2. A peripheral trough 30 is disposed near the edge of each restraint wheel 3 so that each actuation claw 16 can be engaged with the restraint wheel 3 with the same rotatable. The slide rod 14 is led through the central through hole 33 of the restraint wheel 3.

Referring to FIG. 3, as the dial wheels 20 in engagement with the restraint wheels 3 are rotated to right positions with the keyways 32 of the restraint wheels 3 coming into alignment with the keys 17 on the slide rod 14, the second releasing rod 185 is pressed down so to make the recess 188 thereof to move in right engagement with the slide rod 14 as shown in FIGS. 11, 12. Thereby, the latch head 141 biased by the spring 145 is released to withdraw into the casing 10 along with the backwardly moved slide rod 14 and the combination lock is unlocked accordingly.

In the meanwhile, the operator must press the first abutment rod 15 which is in associatioin with the actuation rod 12, when a new code is to be set. By way of the cam contour 150 of the first abutment rod 15, the actuation rod 12 is accordingly made to move forward, resulting in the compression of spring 110. The actuation claws 16 in engagement with the restraint wheels 3 are used to make the wheels 3 out of engagement with the digital dial wheels 20. Meanwhile, the actuation rod 12 is limited to move as a result of the recess 121 of the actuation rod 12 being in abutment with the first releasing rod 13 which is pushed by the biased spring 131 to its inoperative position with the recess 132 out of alignment with the recess 121 of the actuation rod 12; this results from the recess 121 of the actuation rod coming into alignment with the recess 132 of the first releasing rod 13 as a result of the cam contour 150 of the abutment rod 15 being in urging contact with the actuation rod 12, the actuation rod 12 will be moved accordingly to such a position that the recess 121 thereof comes into alignment with the first releasing rod 13, permitting the rod 13 to shoot out by means of the spring 131 and then limit the actuation rod to move, as shown in FIGS. 9, so that the actuation rod 12 will not bounce back by the spring 110 on the releasing of the abutment rod 15; afterwards, the dial wheels 20 are rotated to selected numbers, and then the releasing rod 13 is pressed so as to make the recess 132 if the releasing rod 13 comes into alignment with the actuation rod 12, permitting the rod 12 to move the restraint wheels 3 to come into operation engagement with the dial wheels 20 by way of the spring 110, ending up with the code of combination lock newly set.

Moreover, as shown in FIGS. 3, 4, there are a plurality of axially oriented grooves 23 disposed on the cylindrical protrusion 2 of each dial wheel 20. A tubular elememt 4 is secured to the casing 10 right under each dial wheel 20, and a spring 40 is received within the tubular element 4 with a bullet-shaped engagement member 41 placed thereabove which is in resilient engagement with the grooves 23 of the dial wheel 20 when the same is rotated so that the dial wheel 20 can be operated precisely.

I claim:

1. A combination lock with code thereof randomly set comprising:

an oblong casing;

an actuation rod disposed in said casing and supported in place by a wall mounting seat near the left end thereof and by a tubular protrusion having a bias spring located therein at the rightmost end thereof so to permit the actuation rod to resiliently retreated; adjacent to said rightmost end thereof there being disposed a recess at where a first releasing rod having a recess for the passage of said actuation rod is orthogonally engaged with said actuation rod; the leftmost end thereof being in selective contact with a cam contour of a first abutment rod; on the middle of said actuation rod being secured at least two C-shaped actuation claws each having two spaced legs extended downwardly;

a slide rod disposed in parallel with said actuation rod and supported in place at the right end thereof by a wall protruded tube extended from said casing and; in said tube being disposed a spring which is in abutment relation with an enlarged portion of said slide rod at the right end thereof so to keep said slide rod resiliently operated back and forth when actuated and released; a supporting seat being fixed on the wall of said casing for holding the left end of said slide rod in place; next to said slide enlarged portion of the slide rod being disposed a recess which is in selective engagement with a second releasing rod having a recess thereon orthogonally for the passage of said slide rod and being disposed with respect said slide rod; the leftmost end thereof being inselective contact engagement with the cam contour of a second abutment rod; on the slide rod there being disposed at least two square key means each of which is in alignment with a corresponding keyway disposed on a restraint wheel which is in engagement with one of said actuation claw respectively; the right end of said slide rod being retractably extended out of said casing, serving as a latch head;

at least a pair of dial wheels rotatably mounted on said slide rod with part thereof being exposed externally of said casing; on the periphery of each said dial wheel being provided with a plurality of spaced ditches for easy dialing operation thereof, which divided the periphery thereof into ten sections marked by numerals 0–9; and there being ten through holes defined in accordance with said ten sections on the wall of each said dial wheel;

at least two restraint wheels in correspondence to said dial wheels being slidably disposed on said slide rod with each thereof located next to each said dial wheel; the periphery of each restraint wheel being provided with a trough so that each said actuation claw can be engaged therewith; and on side thereof in contact with said dial wheel being provided with a pair of symmetric protrusion rods which are in selective registry with two of said through holes when the restraint wheel is moved by said actuation claw of said actuation rod; the center of each restraint wheel being provided with a central hole with a keyway in correspondence to one of said key on said slide rod, so that when the restraint wheels in engagement with said dial wheels are rotated to right positions with the keys and said keyways being in alignment with each other, and the second releasing rod pressed down at the same time so to make the recess of the second releasing rod come in alignment with slide rod which will be automatically push backward by spring force thereby the latch head is retreated into the casing, effecting the unlocking of the lock;

each said first and second releasing rods being exposed externally of said casing at one end and resiliently biased by a spring at the other end; said spring being located in a wall protruded tube;

a first and second abutment rods each having one end exposed externally of said casing and the other end thereof located in a wall protruded tube with a spring disposed therein to make the abutment rod resiliently operated; at the middle of thereof being provided with a cam contour which can be in urging abutment with the left end of said actuation rod and slide rod respective so to make the same move on the ends thereof being pressed down;

whereby the code can be varied, with said slide rod being in a unlocked position, the operator presses down the first abutment rod to make said actuation rod moving against the biasing spring, in the meanwhile, the first releasing rod is actuated to a position to prevent the actuation rod from resuming its original position; the moved actuation rod will make said restraint wheels disengage with said dial wheels by way of said actuation claws so that said dial wheels are able to be rotated randomly to new positions; afterward, said first releasing rod is pressed down so to let go of said actuation rod, causing the actuation claws to make said restraint wheels to come into engagement with said dial wheels again, then the dial wheels are randomly rotated to complete the setting of a new code.

2. A combination lock as claimed in claim 1 wherein each said dial wheel is provided with a cylindrical protrusion with said 10 through holes on said dial wheel extended continuously thereon; on the periphery of said cylindrical protrusion there are disposed a number of axially oriented grooves in correspondence with the 10 ditches on the periphery of said dial wheel; each cylindrical protrusion is in contact with a bullet-shaped engagement member housed in a tubular element with a biasing spring disposed thereunder so to resiliently urge said bullet-shaped engagment member against said periphery of said cylindrical protrusion and fall in one of said grooves constantly to stop said dial wheel from moving.

* * * * *